US007813662B2

(12) United States Patent
Muto et al.

(10) Patent No.: US 7,813,662 B2
(45) Date of Patent: Oct. 12, 2010

(54) TRANSFER UNIT AND IMAGE FORMING APPARATUS USING THE UNIT

(75) Inventors: Tetsuya Muto, Kawasaki (JP); Ken Yoshida, Chigasaki (JP)

(73) Assignee: Ricoh Company Limited, Tokyo (JP)

( * ) Notice: Subject to any disclaimer, the term of this patent is extended or adjusted under 35 U.S.C. 154(b) by 240 days.

(21) Appl. No.: 12/119,050

(22) Filed: May 12, 2008

(65) Prior Publication Data

US 2008/0279589 A1 Nov. 13, 2008

(30) Foreign Application Priority Data

May 11, 2007 (JP) ..... 2007-127055

(51) Int. Cl.
*G03G 15/16* (2006.01)

(52) U.S. Cl. ..... 399/66; 399/302; 399/308

(58) Field of Classification Search ..... 399/38, 399/66, 107, 115, 121, 297–302, 308
See application file for complete search history.

(56) References Cited

U.S. PATENT DOCUMENTS

| | | | | |
|---|---|---|---|---|
| 5,752,137 | A * | 5/1998 | Haneda | 399/223 |
| 6,160,980 | A * | 12/2000 | Ziegelmuller et al. | 399/303 |
| 7,003,238 | B2 | 2/2006 | Yoshida et al. | |
| 7,162,179 | B2 | 1/2007 | Yoshida | |
| 7,267,914 | B2 * | 9/2007 | Yamanami et al. | 430/60 |
| 7,280,792 | B2 | 10/2007 | Sawai et al. | |
| 2007/0127960 | A1 | 6/2007 | Yoshida | |
| 2007/0280748 | A1 | 12/2007 | Yoshida | |
| 2008/0088883 | A1 | 4/2008 | Yoshida | |

FOREIGN PATENT DOCUMENTS

| | | |
|---|---|---|
| EP | 1 903 406 A2 | 3/2008 |
| JP | 5-307279 | 11/1993 |
| JP | 6-202430 | 7/1994 |
| JP | 7-301973 | 11/1995 |
| JP | 2001-51467 | 2/2001 |
| JP | 2002-14515 | 1/2002 |
| JP | 2003-107853 | 4/2003 |
| JP | 2004-264792 | 9/2004 |
| JP | 2005-24936 | 1/2005 |

* cited by examiner

*Primary Examiner*—Hoan Tran
(74) *Attorney, Agent, or Firm*—Oblon, Spivak, McClelland, Maier & Neustadt, L.L.P.

(57) ABSTRACT

An image forming apparatus includes a plurality of image forming units and a plurality of transfer units. The image forming units have corresponding image carriers and charging units. The image forming units form toner images of different colors on the corresponding image carriers. The transfer units face the corresponding image carriers to form transfer areas between the transfer units and the image carriers, and press a transfer member to the corresponding image carriers to transfer the toner images onto the transfer member at the transfer areas. The charging units include at least one corona-type charger and at least one contact-type charger. The image forming apparatus sets a first transfer condition for the transfer unit(s) corresponding to the image carrier(s) charged by the at least one corona-type charger and a second, separate transfer condition for the transfer unit(s) corresponding to the image carrier(s) charged by the at least one contact-type charger.

20 Claims, 5 Drawing Sheets

TRANSFER UNIT AND IMAGE FORMING APPARATUS USING THE UNIT

CROSS-REFERENCE TO RELATED APPLICATIONS

The present patent application claims priority under 35 U.S.C. §119 from Japanese Patent Application No. 2007-127055, filed on May 11, 2007 in the Japan Patent Office, the entire contents of which are hereby incorporated herein by reference.

BACKGROUND OF THE INVENTION

1. Field of the Invention

The present invention relates to an electrophotographic image forming apparatus and a transfer unit used therein.

2. Description of the Background

Image forming apparatuses are used as copiers, facsimile machines, printers, or multi-functional devices thereof. Conventionally, various types of color image forming apparatuses have been proposed. For example, one type of color image forming apparatus employs a direct transfer method in which toner images formed on a plurality of image carriers are directly and collectively transferred onto a recording medium. Alternatively, another type of color image forming apparatus employs an intermediate or indirect transfer method in which toner images are primarily and collectively transferred onto an intermediate transfer member and then transferred onto a recording medium.

In either type, such electrophotographic color image forming apparatus typically charges each image carrier by a charging unit of an image forming unit and emits a light beam from a light source, for example, a laser diode (LD) or light-emitting diode (LED), to write an electrostatic latent image on the surface of each image carrier. Then, such electrophotographic image forming apparatus visualizes the latent image by a developing unit to from a toner image on the surface of each image carrier.

Further, one type of color image forming apparatus employing an intermediate transfer method has a plurality of image forming units that contact an intermediate transfer member, serving as a transfer member, at different positions. The intermediate transfer member may be, for example, an endless-shaped intermediate transfer belt extending over a plurality of rollers.

Such image forming apparatus has a plurality of primary transfer units corresponding to the image forming units. Each primary transfer unit transfers a toner image, formed on each image carrier, onto the intermediate transfer belt. Specifically, in each primary transfer unit, a primary transfer area is formed between each image carrier and the intermediate transfer belt. By action of transfer electric field generated at each primary transfer area, the toner image on each image carrier is transferred onto the intermediate transfer belt.

When using such intermediate transfer member, such image forming apparatus has a secondary transfer unit with which the toner images on the intermediate transfer member are transferred onto a recoding medium such as a paper sheet. Specifically, a transfer electric field is generated at a secondary transfer area between the intermediate transfer belt and the recording medium. By action of such transfer electric field, the toner images on the intermediate transfer belt are transferred onto the recording medium.

The electrostatic latent images formed on the respective image carriers are developed with charged toners of different colors. At the primary transfer area at which each image carrier and the intermediate transfer belt contacts and faces each other, typically a transfer bias is applied to the intermediate transfer member, thereby generating a transfer electric field. By action of such electric field, the toner images on the image carriers are transferred in turn onto the intermediate transfer member to form a color image.

Such transfer units need to transfer the toner images onto the intermediate transfer member or recording medium so that its original image is precisely and stably reproduced before and after the transfer process. In other words, to achieve a performance level suitable for such primary and secondary transfer units, a transfer process needs to be stably conducted with a relatively high transfer efficiency.

Such color image forming apparatuses may have a charging member using a corona charging method or a charging member using a contact charging method. One example of corona charging member is an electrifying charger, and one example of contact charging member is a charging roller.

In a corona charging method, a charging member may have discharge electrodes, such as wire electrodes, and shield electrodes surrounding the discharge electrodes. Such corona charging member applies high voltages to the discharge electrodes and shield electrodes to generate a corona shower, and charges the surface of a charged body, such as an image carrier, by the corona shower to a certain electric potential. However, such corona charging method may generate a relatively large amount of ozone and/or may need a relatively high voltage.

In this regard, recent years certain types of contact charging methods have come into practical use because of advantages such as a relatively low ozone generation rate and electric consumption compared to the corona charging method. For one contact charging method, a charging bias is applied to a charging member in contact with a charged body, so that a surface of the charged body is charged to a certain potential. Such contact charging method may be performed by a charging member of, for example, roller-type, fur-brush-type, magnetic-brush-type, or blade-type.

For one roller-type charging member (hereinafter "charging roller"), direct-current (DC) bias and alternating-current (AC) bias are superposed one on the other to be applied to the charging roller, so that the surface of the charging member is uniformly charged to a certain potential. However, for such charging roller, the application of AC bias may result in a larger discharge amount than the above-described corona charging member, thereby resulting in damage to an image carrier or photoconductor, for example, curling or roughness of the surface of photoconductor.

To prevent such damage, lubricant may be applied to the surface of photoconductor. Such lubricant may prevent the curling of the surface of photoconductor, although a portion of lubricant may be fixed to the charging roller, thereby inhibiting the surface of photoconductor from being uniformly charged.

Accordingly, optimization has been attempted to obtain an application amount of lubricant compatible for both the curling of the surface of photoconductor and the adhesion of lubricant to the surface of photoconductor. However, it is quite difficult to find a completely-compatible application amount for both factors, and thus the service life of charging roller may be put second.

The above-described corona charging method is a non-contact charging method. Such non-contact charging method can relatively suppress deterioration of a charging unit due to lubricant or toner, thereby suppressing damages to a photoconductor. Accordingly, to prevent damages to the photoconductor, a sufficient amount of lubricant can be applied to the surface of photoconductor with little consideration of contamination of such lubricant or toner to the charging unit.

Thus, the corona charging member may have disadvantages in ozone generation amount and electric consumption compared to the charging roller. By contrast, the corona charging member may have advantages in service life compared to the charging roller.

As another type of charging method, a proximate charging method has been proposed in which a charging roller is disposed proximate to and in non-contact with a photoconductor. Such configuration may prevent a reduction in charging performance due to foreign matter attached to the photoconductor, for example, while suppressing the generation amount of ozone by utilizing a charging property similar to that of the contact charging method.

In consideration of such characteristic of each charging method, one type of conventional image forming apparatus has a plurality of toner-image forming units each including any one of the electrifying charger and the charging roller according to toner color. For example, such electrifying charger, which has a relatively long service life, may be used in a frequently-used image forming unit of black color while such charging roller, which has a relatively low ozone generation rate and electric consumption, may be used in a less-frequently-used image forming unit of a color other than black. Such configuration can reduce the frequency of maintenance operations in the image forming apparatus, thereby facilitating a reduction in the generation amount of ozone and electric consumption, which are increasingly demanded from a viewpoint of environmental concern.

Such conventional image forming apparatus may also have a plurality of pressing units that press the intermediate transfer member to the surfaces of image carriers at respective primary transfer positions. Applying such pressure to a transfer area between each image carrier and the intermediate transfer member during the primary transfer process can enhance transfer efficiency, thereby preventing occurrences of transfer failures such as white dropout in a transferred image.

Accordingly, using such pressing units can suppress waving of the intermediate transfer member at each transfer position. As a result, the intermediate transfer member can uniformly contact the surface of each image carrier, thereby suppressing transfer irregularity.

However, when pressing the transfer area between the intermediate transfer member and each image carrier, stress may be concentrated on a portion of the toner image formed on the intermediate transfer member, thereby resulting in partial dropout of toner image during the transfer process (hereinafter "image dropout"). Such image dropout during the transfer process may notably appear when a relatively large amount of toner is attached to the intermediate transfer unit as in the case where multi-color images are superimposed one on another.

To prevent such image dropout, one type of conventional image forming apparatus sets a contacting pressure of a pressing unit within a certain range. Alternatively, for another type of conventional image forming apparatus, a contacting pressure at a transfer area on a downstream side in a sheet transfer direction thereof is set lower than a contacting pressure at a transfer area on an upstream side.

Still another type of conventional image forming apparatus employs different contacting pressures between a transfer nip of black toner and a transfer area on the uppermost stream. Still another type of conventional image forming apparatus is a tandem-type image forming apparatus that includes a corona charging member and a contact charging member.

However, for such conventional image forming apparatus including a corona charging member and a contact charging member, shortage of transfer efficiency or image dropout during the transfer process may be generated. Alternatively, in such conventional image forming apparatus employing an intermediate transfer member, when a toner image is secondarily transferred onto a recording medium, such as a paper sheet, of low smoothness, a transfer performance may vary due to irregularity of the surface of recording medium. As a result, image quality may be degraded, thereby resulting in surface roughness or image-density irregularity of a resultant image.

Consequently, there is still a need for an image forming apparatus including a transfer unit capable of effectively suppressing failures such as shortage of transfer efficiency, image dropout during the transfer process, and patchy irregularity of image-density.

SUMMARY OF THE INVENTION

Exemplary embodiments of the present invention provide a developing unit, process cartridge, image forming method and apparatus capable of preventing failures that may be caused by developer dropping through a gap between a developer carrier and an end portion of a separation member.

In one exemplary embodiment of the present invention, an image forming apparatus includes a plurality of image forming units and a plurality of transfer units. The plurality of image forming units have corresponding image carriers and charging units. The image forming units form toner images of different colors on the corresponding image carriers. The plurality of transfer units are disposed to face the corresponding image carriers to form transfer areas between the transfer units and the image carriers and are configured to press a transfer member, passing through the transfer areas, to the corresponding image carriers to transfer the toner images, formed on the corresponding image carriers, onto the transfer member at the transfer areas. The charging units include at least one charging member of corona charging type and at least one charging member of contact charging type. The image forming apparatus sets a first transfer condition for the transfer unit(s) corresponding to the image carrier(s) charged by the at least one charging member of corona charging type and a second, separate transfer condition for the transfer unit(s) corresponding to the image carrier(s) charged by the at least one charging member of contact charging type.

In another exemplary embodiment, an image forming apparatus includes a plurality of image forming units and a plurality of transfer units. The plurality of image forming units has corresponding image carriers and charging units. The image forming units form toner images of different colors on the corresponding image carriers. The plurality of transfer units are disposed to face the corresponding image carriers to form transfer areas between the transfer units and the image carriers and are configured to press a transfer member, passing through the transfer areas, to the corresponding image carriers to transfer the toner images, formed on the corresponding image carriers, onto the transfer member at the transfer areas. The charging units include at least one charging member of corona charging type and at least one charging member of proximate charging type. The image forming apparatus sets a first transfer condition for the transfer unit(s) corresponding to the image carrier(s) charged by the at least one charging member of corona charging type and a second, separate transfer condition for the transfer unit(s) corresponding to the image carrier(s) charged by the at least one charging member of proximate charging type.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
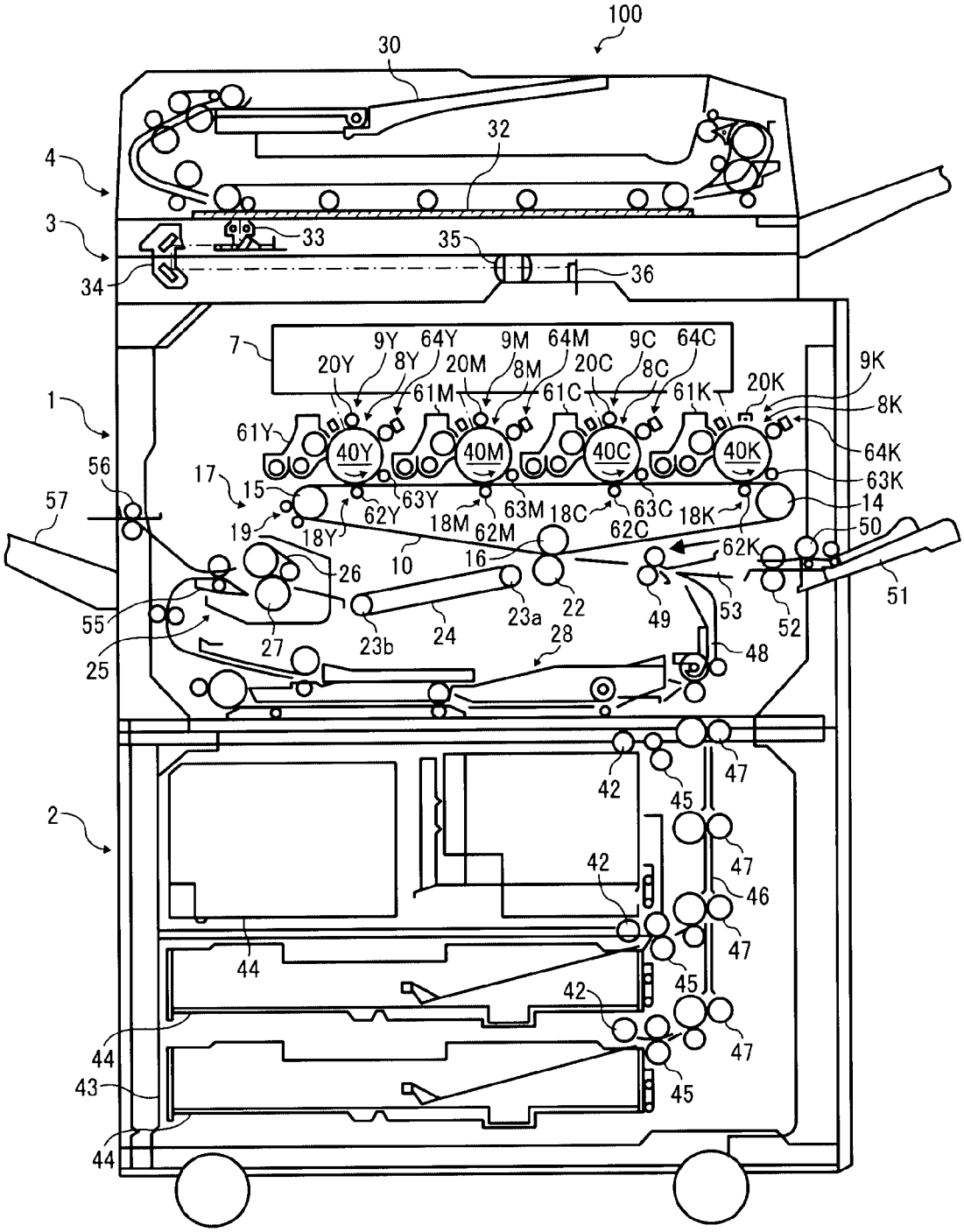
FIG. 1 is a schematic view illustrating a transfer unit and an image forming apparatus according to an exemplary embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve the same results. For the sake of simplicity, the same reference numerals are used in the drawings and the descriptions for the same materials and constituent parts having the same functions, and redundant descriptions thereof are omitted.

Exemplary embodiments of the present disclosure are now described below with reference to the accompanying drawings. It should be noted that, in a later-described comparative example, exemplary embodiment, and alternative example, the same reference numerals are used for the same constituent elements such as parts and materials having the same functions and achieving the same effects, and redundant descriptions thereof are omitted.

FIG. 1 is a schematic view illustrating a configuration of an image forming apparatus having a transfer unit according to an exemplary embodiment of the present invention.

In FIG. 1, the image forming apparatus 100 is illustrated as an electrophotographic color copier having a plurality of photoconductors arranged in a tandem manner. It should be noted that an image forming apparatus according to an exemplary embodiment of the present invention is not limited to such color copier and may be a printer, scanner, facsimile machine, multi-functional device, or any other suitable type of image forming apparatus.

In FIG. 1, the image forming apparatus 100 has an intermediate transfer belt 10 as a transfer member. The image forming apparatus 100 also has a sheet feed table 2 at a bottom portion thereof. A copier body 1, scanner 3, and auto document feeder (ADF) 4 are sequentially stacked on the sheet feed table 2 from bottom to top.

The copier body 1 has a transfer device 17 at a substantially middle portion thereof. The transfer device 17 includes the intermediate transfer belt 10 having an endless shape. The intermediate transfer belt 10 is extended over a driving roller 14, driven roller 15, and driven roller 16 and is rotationally traveled in a clockwise direction in FIG. 1. During the traveling, a cleaner 19, disposed on the left side of the driven roller 15, cleans residual toner, which remains on a surface of the intermediate transfer belt 10 after image transfer, to prepare for a next image forming operation of the transfer device 17.

As illustrated in FIG. 1, above a linear portion of the intermediate transfer belt 10 extending between the driving roller 14 and driven roller 15 may be disposed four process cartridges 8Y, 8M, 8C, and 8K in that order along the traveling direction of the intermediate transfer belt 10. Above the process cartridges 8Y, 8M, 8C, and 8K is disposed an exposure unit 7.

The process cartridges 8Y, 8M, 8C, and 8K serve as image forming units to form toner images of yellow, magenta, cyan, and black, respectively. The process cartridges 8Y, 8M, 8C, and 8K include photoconductors 40Y, 40M, 40C, and 40K, respectively, serving as image carriers. The photoconductors 40Y, 40M, 40C, and 40K each are rotatable in a counterclockwise direction in FIG. 1.

Hereinafter, the photoconductors 40Y, 40M, 40C, and 40K are referred to "photoconductors 40" when the colors need not to be distinguished, which is applied to other components and units.

Around the photoconductors 40Y, 40M, 40C, and 40K are disposed charging units 9Y, 9M, 9C, and 9K, developing units 61Y, 61M, 61C, and 61K, transfer units 18Y, 18M, 18C, and 18K, cleaning units 63Y, 63M, 63C, and 63K, and lubricant applicators 64Y, 64M, 64C, and 64K, respectively. Among such units, the charging units 9Y, 9M, 9C, and 9K, developing unit 61Y, 61M, 61C, and 61K, cleaning units 63Y, 63M, 63C, and 63K, and lubricant applicators 64Y, 64M, 64C, and 64K are mounted on the process cartridges 8Y, 8M, 8C, and 8K, respectively.

Each charging unit 9 has a charging member and a power supply that applies a charging bias to the charging member. For example, the charging units 9Y, 9M, and 9C for yellow, magenta, and cyan may have charging rollers 20Y, 20M, and 20C as adjacent-type charging members, while the charging unit 9K may have an electrifying charger 20K as a transfer-type charging member. It should be noted that, in accordance with design concepts, any suitable types of charging rollers may be used as the charging rollers 20Y, 20M, and 20C and any suitable type of electrifying charger may be used as the electrifying charger 20K.

In such configuration, the charging rollers 20Y, 20M, and 20C are disposed to have small gaps with respect to respective surfaces of the photoconductors 40Y, 40M, and 40C. Such gaps are preferably set in a range of approximately 0.02 to 0.06 millimeters (mm). If such gaps are smaller than 0.02 mm, each photoconductor may undesirably contact the corresponding charging roller, thereby negating advantages of such non-contact-type charging system.

Similarly, the electrifying charger 20K is disposed to have a small gap with respect to the photoconductor 40K. The gap is preferably set to 1.5 mm, for example.

As described above, in the present exemplary embodiment, the photoconductors 40Y, 40M, and 40C are charged by adjacent-type charging members, although it should be noted that the photoconductors 40Y, 40M, and 40C may be charged by contact-type charging members.

The transfer units 18Y, 18M, 18C, and 18K are disposed inside the intermediate transfer belt 10 to face the photoconductors 40Y, 40M, 40C, and 40K, respectively. The transfer units 18Y, 18M, 18C, and 18K have primary transfer rollers 62Y, 62M, 62C, and 62K, respectively, that press the corresponding photoconductors 40 via the intermediate transfer belt 10. Each transfer unit 18 also have a bias supply that applies a transfer bias to the corresponding primary transfer roller 62. Each primary transfer roller 62 contacts the intermediate transfer belt 10 with pressure to form a primary transfer area between the intermediate transfer belt 10 and each photoconductor 40.

Figure 2:
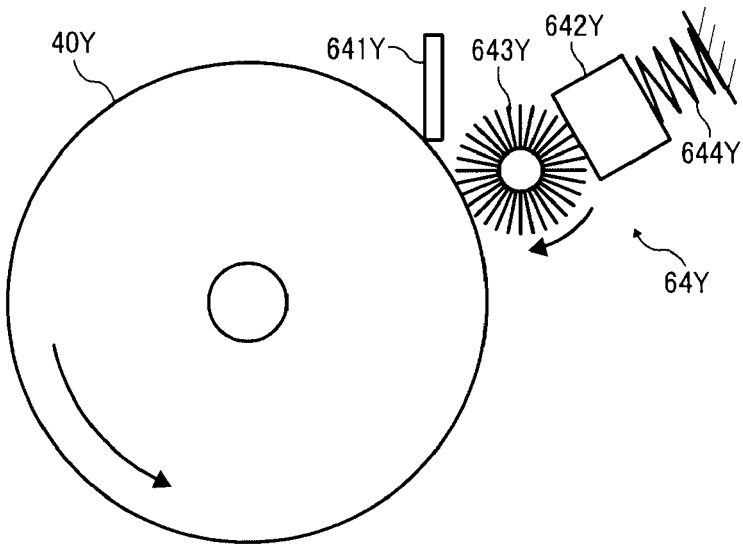
FIG. 2 is a schematic view illustrating a lubricant applicator used in the image forming apparatus of FIG. 1.

The lubricant applicators 64Y, 64M, 64C, and 64K have substantially identical configurations, and therefore as a representative example the configuration of the lubricant applicator 64Y is described below with reference to FIG. 2.

The lubricant applicator 64Y have an application blade 641Y, a lubricant 642Y, a lubricant application brush 643Y, and a spring 644Y. The application blade 641Y and the lubricant application brush 643Y each contact the surface of the photoconductor 40Y. The spring 644Y presses the lubricant 642Y against the lubricant application brush 643Y. In the lubricant applicator 64Y, rotation of the lubricant application brush 643Y causes a desired amount of the lubricant 642Y to be attached to the lubricant application brush 643Y. Further, the lubricant application brush 643Y, while rotating, contacts the photoconductor 40Y and thus applies the lubricant 642Y to the surface of the photoconductor 40Y. Then, the lubricant blade 641Y spreads the lubricant 642Y in a substantially uniform thickness on the photoconductor 40Y.

As illustrated in FIG. 1, a secondary transfer unit 22 is disposed below the intermediate transfer belt 10. In FIG. 1, the secondary transfer unit 22 is a roller member that contacts the driven roller 16 with pressure via the intermediate transfer belt 10. A secondary transfer area is formed at such contact area between the secondary transfer unit 22 and the intermediate transfer belt 10. When a recording medium (hereinafter "sheet") is sent to the secondary transfer area, the secondary transfer unit 22 collectively transfers the toner images, formed on the intermediate transfer belt 10, onto the sheet.

As described above, in the present exemplary embodiment, the secondary transfer unit 22 is described as a roller-type charger, although it should be noted that such secondary transfer unit may be a non-contact-type charger.

Below the secondary transfer unit 22 may be disposed a sheet reversing unit 28 that turn a sheet upside down when forming images on both faces of the sheet.

In FIG. 1, the image forming apparatus 100 also has a fixing device 25 that fixes the toner images on the sheet. The fixing device 25 is disposed on a downstream side in a sheet conveyance direction of the secondary transfer unit 22. In the fixing device 25, a pressure roller 27 contacts a fixing belt 26 with pressure. After the secondary transfer process, a transfer belt 24 extending between a pair of rollers 23*a* and 23*b* conveys the sheet to the fixing device 25.

With the image forming apparatus 100 thus configured, when conducting simplex color copying, an original document may be set on a document tray 30 of the auto document feeder 40. Alternatively, such original document may be manually set on a contact glass 32 of the scanner 3 by opening the auto document feeder 4 and then be pressed against the contact glass 32 by closing the auto document feeder 4.

When setting the original document on the auto document feeder 4, for example, a user may press a start button to automatically feed the original document to the contact glass 32. Alternatively, when a user manually sets the original document on the contact glass 32, the scanner 3 is quickly activated, and a first carriage 33 and second carriage 34 start scanning. A light beam emitted from a light source of the first carriage 33 is reflected approximately 180 degrees by a pair of mirrors of the second carriage 34. The reflected light beam passes through a focus lens 35 and enters a scanning sensor 36. Thus, the content of the original document is scanned.

Meanwhile, when the start button is pressed as described above, rotation of the intermediate transfer belt 10 is started. Further, rotation of the photoconductors 40Y, 40M, 40C, and 40K is started, and single-color toner images of yellow, magenta, cyan, and black are formed on the photoconductors 40Y, 40M, 40C, and 40K, respectively. Then, while the intermediate transfer belt 10 is rotated in the clockwise direction in FIG. 1, the single-color toner images are transferred in a superimposed manner at the primary transfer areas onto the intermediate transfer belt 10. Thus, a full-color composite toner image is formed on the intermediate transfer belt 10.

In FIG. 1, the sheet feed table 2 has a plurality of sheet cassettes 44 in a paper bank 43. When one sheet cassette 44 is selected from among the plurality of sheet cassettes 44, a corresponding sheet feed roller 42 of the selected sheet cassette 44 is rotated to pick up sheets from the selected sheet cassette 44. The sheets are separated one by one by a separation roller 47 and are transported to a feed path 46. Further, each sheet is transported by a transport roller 47 to a feed path 48 of the copier body 1 and is abutted against a registration roller 49 to temporarily stop.

Alternatively, for manual sheet feeding, sheets loaded on a manual feed tray 51 are picked up by rotation of a feed roller 50 and are separated by a separation roller 52 one by one into a manual feed path 53. Each sheet is abutted against the registration roller 49 to temporarily stop.

In either case, rotation of the registration roller 49 is started at a timing synchronized with a timing at which the composite color image on the intermediate transfer belt 10 reaches the registration roller 49. Thus, the registration roller 49 sends the sheet, temporarily stopped, to the secondary transfer area between the intermediate transfer belt 10 and the secondary transfer unit 22, and then the composite color image is transferred by the secondary transfer unit 22 onto the sheet.

Further, the sheet having the composite color image is forwarded by the secondary transfer unit 22 and the transfer belt 24 to the fixing device 25. In the fixing device 25, the composite color image is fixed by heat and pressure on the sheet. The sheet is guided by a switching member 55 to an ejection side, for example, and is ejected by an ejection roller 56 to a stack tray 57.

Alternatively, when duplex copying mode is selected, the sheet having the composite color image on its front face is guided by the switching member 55 to the sheet reversing unit 28. When the sheet is turned upside down in the sheet reversing unit 28, the sheet is sent back to the secondary transfer area again. When another image is formed on the back face of the sheet, the sheet is ejected by the ejection roller 56 to the stack tray 57.

In the present exemplary embodiment, the transfer device 17 has the transfer units 18Y, 18M, 18C, and 18K and the secondary transfer unit 22. The transfer device 17 may have a configuration in which, when forming a single-color toner image, for example, black toner image, the driven rollers 15 and 16 are moved downward to separate the photoconductors 40Y, 40M, and 40C from the intermediate transfer belt 10.

In the present exemplary embodiment, the image forming apparatus 100 is described as a tandem-type color copier of FIG. 1, although it should be noted that an image forming apparatus according to an exemplary embodiment may be a single-drum-type image forming apparatus having only one photoconductor, for example. Typically, such an image forming apparatus forms a black toner image at first, and then forms other colors only when multi-color image formation is needed.

In such configuration, the registration roller 49 may be connected to ground so that a bias is applied to the registration roller 49 to remove paper dust. For example, when such bias is applied to the registration roller 49 by a conductive rubber roller, which has a diameter of 18 mm and a surface covered with a conductive nitrile butadiene rubber (NBR) having a thickness of 1 mm, the volume resistance of the rubber material may become approximately 109 Ωcm. In such case, for example, a voltage of approximately minus 800V may be applied to the front face of the sheet onto which toner is transferred while a voltage of approximately plus 200V may be applied to the back face of the sheet. In such intermediate transfer method, generally paper dust is unlikely to reach the photoconductor 40. Therefore, there is little need to consider the transfer of such paper dust, and the registration roller 49 is allowed to be connected to ground.

Generally, a DC (direct-current) bias is used as the applied voltage, although it should be noted that an AC (alternative-current) bias including a DC offset component may be used as the applied voltage, thereby allowing the sheet to be more uniformly charged.

After the sheet passes through the registration roller 49 to which such bias has been applied, the surface of the sheet is slightly negatively charged. As a result, when the toner image is transferred from the intermediate transfer belt 10 to the sheet, conditions of the transfer process may differ from those of the case in which such bias is not applied to the registration roller 49. Accordingly, when such bias is applied to the registration roller 49, the transfer conditions may be modified.

[State of Lubricant Applied to Photoconductor and Measurement of Friction Coefficient of Photoconductor]

In the present exemplary embodiment, for example, the amount of lubricant 642 applied to each of the photoconductors 40Y, 40M, and 40C is set to approximately 150 mg per kilometer of traveling distance of each photoconductor, while the amount of lubricant 642 applied to the photoconductor 40K is set to approximately 50 mg per kilometer of traveling distance of the photoconductor 40K. Such application amounts are preferable from viewpoints of, for example, its possible damage to the photoconductors 40 and fixation of lubricant to the charging members.

Regarding the present exemplary embodiment, for example, the surface friction coefficient of the photoconductor 40K charged by the electrifying charger 20K is set to a relatively small value of 0.08, while the surface friction coefficient of each of the photoconductors 40Y, 40M, and 40K charged by the electrifying chargers 20Y, 20M, and 20C is set to a relatively large value of 0.11.

In this regard, the surface friction coefficient μ of each photoconductor 40 is measured by an Euler belt method. For such measurement, for example, a A4-size plain paper sheet produced by Ricoh Company, Ltd., under product code of TYPE 6200 may be used to prepare a measurement sheet. In such case, the plain sheet is cut down to measurement sheets having a size of 297 mm×30 mm, and a middle portion of each measurement sheet is wrapped over an approximately 90-degree angular range in a circumferential direction of each photoconductor 40. A weight of 100 g (0.98 N) is attached to one end portion of the measurement sheet in its wrapping direction, while a digital push-pull gage is attached to the other end portion thereof. When the weight is stationary, the measurement sheet is pulled at a certain speed. Then, at a moment at which the measurement sheet starts to move, a measurement value of the digital push-pull gage is recorded. Where F[N] represents the measurement value, the friction coefficient μ is expressed by the following equation:

$$\mu=\ln(F/0.98/(\pi/2)).$$

Next, a description is given of relationship between the image dropout during the transfer process and the linear velocity difference between the intermediate transfer belt and each photoconductor.

In the present exemplary embodiment, the linear velocity Vs1 of each photoconductor 40 and the linear velocity Vs2 of the intermediate transfer belt 10 are used as the transfer conditions.

Figure 3:
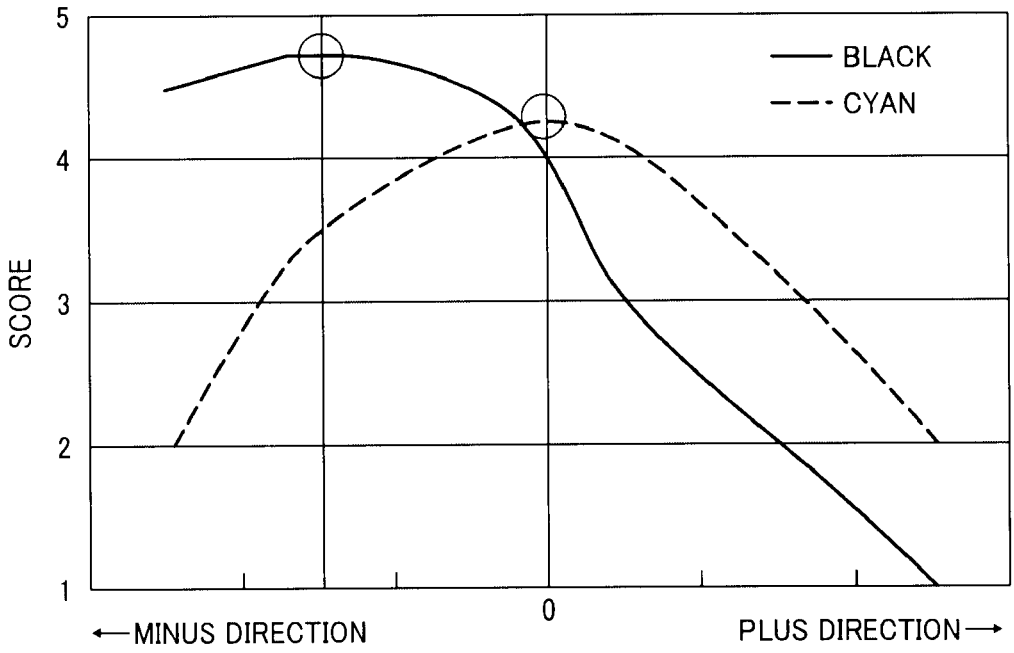
FIG. 3 illustrates relationship between difference in linear velocity between an image carrier and a transfer member and score on image dropout during transfer process.

FIG. 3 illustrates a change in score on image dropout during the transfer process depending on a change in the linear velocity difference between Vs1 and Vs2. In FIG. 3, the vertical axis represents the score on image dropout observed during the intermediate transfer process, and the horizontal axis represents the linear velocity difference between Vs1 and Vs2. A solid curve represents the score property of the photoconductor 40K for black on the image dropout during the intermediate transfer process. On the other hand, a dashed curve represents the score property of the photoconductor 40C for cyan on the image dropout during the intermediate transfer process.

Results of the measurement are scored on a scale of 1 to 5. Score 1 indicates the worst while score 5 the best, and score 4 or greater is considered as acceptable.

In FIG. 3, the linear velocity difference is determined based on the rotation speed of the intermediate transfer belt 10. Specifically, when the rotation speed of the photoconductor 40 is higher than that of the intermediate transfer belt 10, the linear velocity difference is expressed as a negative value. By contrast, when the rotation speed of the photoconductor 40 is lower than that of the intermediate transfer belt 10, the linear velocity difference is expressed as a positive value.

As illustrated in FIG. 3, for the photoconductor 40K having a relatively small friction coefficient of 0.08 described above, a relatively high score on the image dropout is obtained when the linear velocity difference is a negative value.

On the other hand, for the photoconductor 40C having a relatively large friction coefficient of 0.11, the highest score on the image dropout is obtained when the linear velocity difference is approximately zero. Further, as the linear velocity difference is deviated from zero to the positive or negative direction, the score on image dropout decreases.

As described above, when the surface friction coefficient is different between the photoconductors 40, the optimal value of the linear velocity difference with respect to the score on image dropout is also different between the photoconductors 40. Accordingly, when the surface friction coefficient of a photoconductor is relatively small, preferably the linear velocity difference is set to such a negative value, thereby resulting in an excellent image without image dropout during transfer. Alternatively, when the surface friction coefficient of a photoconductor is relatively large, preferably the linear velocity difference is set to zero, thereby resulting in such an excellent image.

Hence, according to the present exemplary embodiment, the linear velocity difference between the photoconductor 40K having the relatively small surface friction coefficient and each of the photoconductor 40Y, 40M, and 40C having the relatively large surface friction coefficient is set to appropriate values based on such measurement results.

[Image Dropout During Transfer and Pressing Force]

In the present exemplary embodiment, the pressing forces of the primary transfer rollers 62Y, 62M, 62C, and 62K against the photoconductors 40Y, 40M, 40C, and 40K are used as the transfer conditions.

Figure 4:
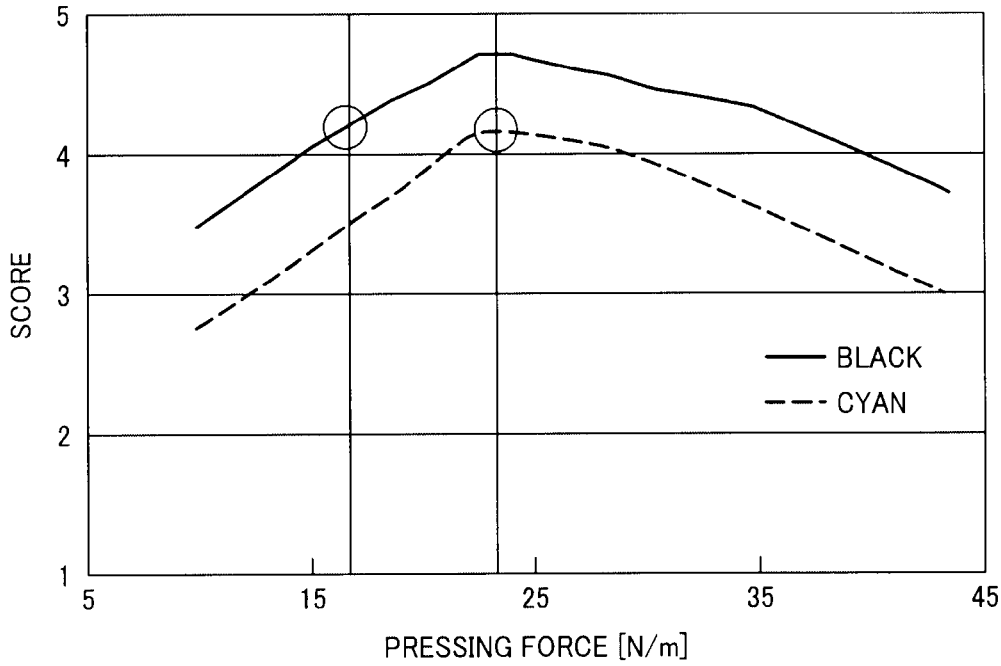
FIG. 4 illustrates relationship between pressing force of a primary transfer member and score on image dropout during transfer process.

FIG. 4 illustrates a change in the score on image dropout during the transfer process depending on a change in the pressing force. In FIG. 4, the vertical axis represents the score on image dropout observed during the transfer process, and the horizontal axis represents the pressing force of the primary transfer rollers against the photoconductors.

A solid line represents the score property of the photoconductor 40K for black on the image dropout during the intermediate transfer process. On the other hand, a dashed curve represents the score property of the photoconductor 40C for cyan on the image dropout during the transfer process.

As was the case with FIG. 3, score 4 or greater is considered as acceptable in FIG. 4 as well.

As illustrated in FIG. 4, as the pressing force of the primary transfer roller 62 decreases, the score on image dropout also decreases. One possible cause of such tendency is that, when the pressing force of the primary transfer roller 62 decreases, the pressure against the photoconductor 40 and the intermediate transfer belt 10 also decreases. Consequently, a sufficient level of transfer pressure may not be generated, thereby resulting in image dropout during the transfer process.

For the photoconductor 40K having a relatively small friction coefficient, toner can easily detach from the surface of the photoconductor 40K. Accordingly, even when the pressing force of the primary transfer roller 62K decreases to some extent, black toner can be appropriately transferred by action of the electric field generated at the transfer area. Thus, a preferable result of score 4 or greater can be obtained for the photoconductor 40K.

However, for the photoconductor 40C for cyan having a relatively large friction coefficient, the dynamical adhesion force between toner and the photoconductor 40C is also large. As a result, for a certain proportion of the toner, the electric field generated at the transfer area cannot overcome such dynamical adhesion force, thereby resulting in image dropout during the transfer process.

Further, regardless of toner colors, an increase in the pressing force may result in a decrease in the score on image dropout during the transfer process. Such pressing force may concentrate on a portion of toner between each photoconductor 40 and the intermediate transfer belt 10, thereby resulting in image droplet during the transfer process.

Such image droplet may be similarly observed in the other photoconductors 40Y and 40M. Accordingly, a preferable range of the pressing force with respect to the image droplet may differ between the electrifying charger and the charging roller, or may vary with the friction coefficient of each photoconductor 40.

[Image-Density Irregularity and Pressing Pressure]

Figure 5:
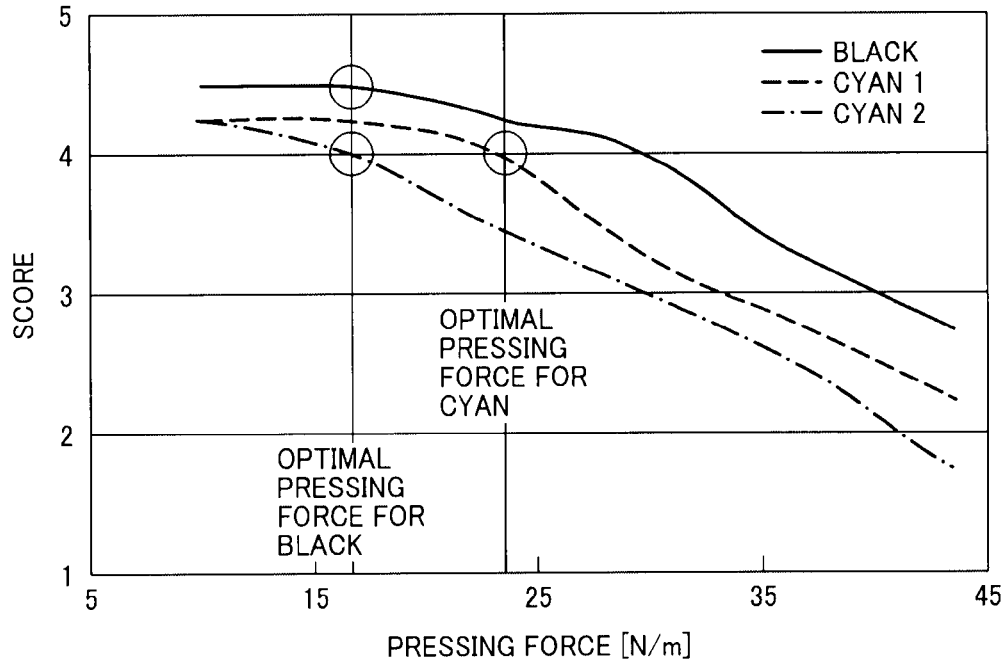
FIG. 5 illustrates relationship between pressing force of a primary transfer member and score on image-density irregularity.

FIG. 5 illustrates relationship between the pressing force of the primary transfer roller against the photoconductor and the image-density irregularity.

In FIG. 5, the vertical axis represents the score on irregularity in image density, while the horizontal axis represents the pressing force of the primary transfer roller against the photoconductor.

A solid line represents a change in the score on image-density irregularity observed when the pressing force of the primary transfer roller 62K against the photoconductor 40K for black varies. A dashed line represents a change in the score on image-density irregularity observed when the pressing force of the primary transfer roller 62C against the photoconductor 40C for cyan varies. A dash-single-dot line represents a change in the score on image-density irregularity observed when the pressing force of the primary transfer roller 62C against the photoconductor 40K for black varies.

As is the case with the score on image dropout during transfer, a higher score indicates a better state with respect to the image-density irregularity of a resultant image. A score of four or greater is considered as acceptable. When the pressing force of the primary transfer roller 62C against the photoconductor 40C for cyan varies, the primary transfer roller 62K is fixed at an optimal pressing force.

As indicated by the solid line and the dashed line of FIG. 5, as the pressing force of the primary transfer roller 62K or 62C decrease, the score on image-density irregularity increase. One possible cause of this is that such decrease in the pressing forces of the primary transfer rollers 62K and 62C may reduce the force of pressing toner against the intermediate transfer belt 10, thereby resulting in a decrease in the dynamical adhesive force acting between toner and the intermediate transfer belt 10. Consequently, the effect of secondary-transfer electric field may become greater than the dynamical adhesive force of the intermediate transfer belt 10 at the secondary transfer area, thereby resulting in an increase in the score on image-density irregularity.

Further, the dashed-and-dot line of FIG. 5 suggests that, when only the pressing force of the primary transfer roller 62K varies, the score on image-density irregularity for other color toner (here, cyan) as well as black toner increases.

In this regard, when the sheet, having other color toner images primarily transferred thereon, passes through the primary transfer area facing the photoconductor 40K, the force against the intermediate transfer belt 10 may temporarily decrease, thereby improving the score on image-density irregularity. Accordingly, a decrease in the pressing force of the primary transfer roller 62K against the photoconductor 40K may improve images of all four colors with respect to the image-density irregularity.

Thus, the optimal range of the pressing force is different between the electrifying charger 20K and each of the charging rollers 20Y, 20M, and 20C. Accordingly, setting separate optimal ranges of the pressing force for the electrifying charger 20K and each of the charging rollers 20Y, 20M, and 20C may improve the scores on both image dropout during transfer and image-density irregularity.

Here, based on the results of image dropout during transfer and image-density irregularity illustrated in FIGS. 4 and 5, respectively, a compatible value of the pressing force for the two indices is considered below.

The pressing force needs to be set in such a preferable range that a resultant image has a score of four or greater on both the image dropout and image-density irregularity. When using the electrifying charger 20K, such preferable range is relatively wide compared to when using the charging rollers 20Y, 20M, and 20C. With the charging rollers 20Y, 20M, and 20C, such preferable range is narrow, and accordingly the pressing force is set to 23 N/m, for example.

For the photoconductor 40K charged by the electrifying charger 20K, the pressing force has effect on the scores on image-density irregularity of other color toner images. Accordingly, the pressing force is set to a relatively small value of 17 N/m, for example, in such preferable range. Such configuration can improve image-density irregularity of all color toner images while suppressing the image dropout during the transfer process. Incidentally, circles in FIGS. 4 and 5 represent optimal pressing forces for black and cyan.

In the present exemplary embodiment, the transfer member is described as a belt-shaped intermediate transfer member, i.e., the intermediate transfer belt 10. It should be noted that the transfer member may be a sheet carried on a transfer convey belt. In such case, similarly, different charging methods may lead to a difference in surface friction coefficient between image carriers, thereby resulting in a reduction in transfer efficiency and white patches. Hence, the present exemplary embodiment is applicable to an image forming apparatus in which the transfer member is a sheet carried on a transfer convey belt, and can provide effects similar to those described above.

Further, in the above description, the primary transfer unit is described as a roller member. It should be noted that the primary transfer unit is not limited to such roller member and may be a brush or blade member. For example, when the primary transfer unit is a brush member, the pressing force may be adjusted by changing the thickness, length, or hardness of the brush member, or the intrusion amount of the brush member to the intermediate transfer belt 10.

Alternatively, when the primary transfer unit is a blade member, similarly the pressing force may be adjusted by changing the thickness, length, or hardness of the brush member, or the intrusion amount of the brush member to the intermediate transfer belt 10.

The pressing force of such primary transfer unit against the photoconductor 40K is preferably in a range of 15 to 30 N/m. The pressing force of the primary transfer unit against each of the photoconductors 40Y, 40M, and 40C is preferably in a range of 21 to 28 N/m. In consideration of image-density irregularity, the pressing force of the primary transfer unit is preferably smaller, more preferably 23 N/m.

Next, another exemplary embodiment for such photoconductors and primary transfer units is described with reference to FIG. 6.

Figure 6:
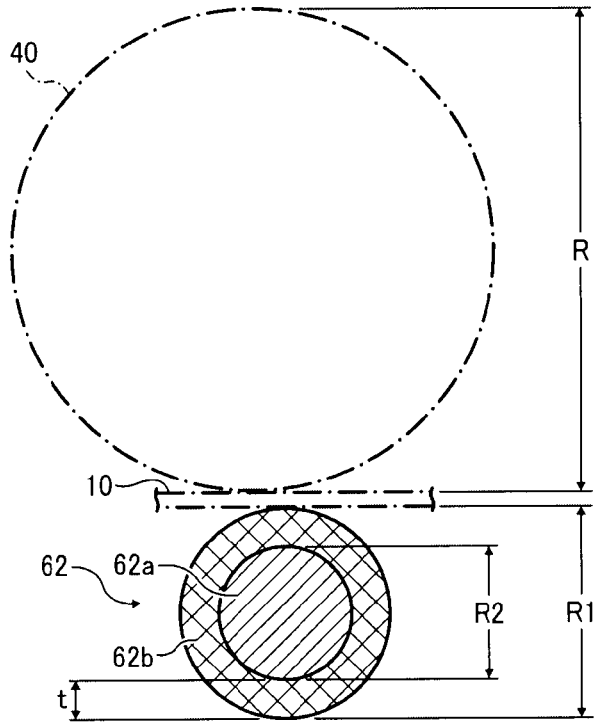
FIG. 6 is an enlarged cross-sectional view illustrating configurations of an image carrier and a primary transfer unit.
Figure 7:
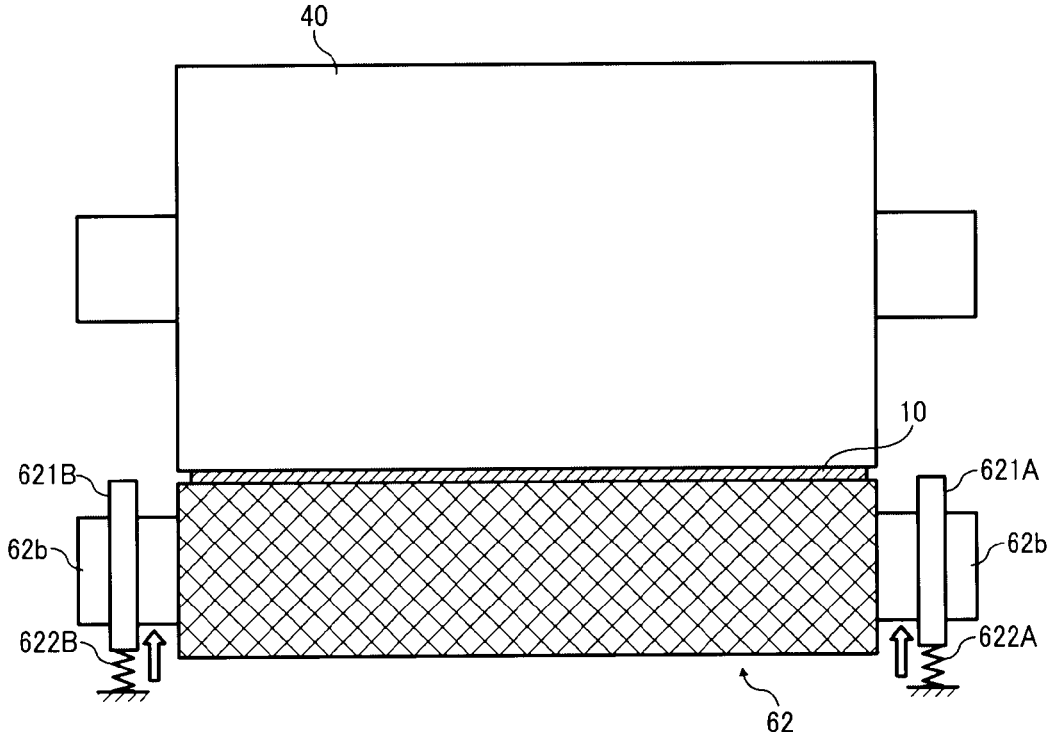
FIG. 7 is an enlarged view illustrating a configuration of a pressing unit.

In FIG. 6, primary transfer rollers 62Y, 62M, 62C, and 62K serving as the primary transfer units have substantially identical structures, and therefore are collectively referred as "primary transfer rollers 62" below. The primary transfer roller 62 includes a core metal 62*a* and a cylindrical sponge member 62*b* around the core metal 62*a*.

In one example, the diameter "R" of the photoconductor 40 is set to 60 mm, the diameter "R1" of the primary transfer roller 62 is set to 16 mm, the diameter "R2" of the core metal 62*a* is set to 10 mm, the thickness "t" of the sponge member 62*b* is set to 3 mm, and the hardness of the sponge 62*b* is set to Asker C-45°, which is preferably in a range of 40° to 60°.

Next, a method of measuring the pressing force is described.

The pressing force of the primary transfer roller 62 is generated by bearings 621A and 621B and compression coil springs 622. The pressing force is expressed by (F+W)/L or (F−W)/L, where "F" represents pressing forces of the compression coil springs 622A and 622B, "W" represents a weight of the primary transfer roller 62, and "L" represents a length of the primary transfer roller 62 in a long direction.

Depending on a relationship between directions of the pressing force and the force of gravity, it is determined whether the term "W" indicating the weight of the primary transfer roller 62 is added to or subtracted from the pressing force "F". For example, in the present exemplary embodiment, the direction of the pressing force is opposite to the direction of the force of gravity. In other words, the weight "W" of the primary transfer roller 62 acts in such a direction as to reduce the pressing force to the photoconductor 40. Therefore, the weight of the primary transfer roller 62 is subtracted from the force of gravity.

Figure 8:
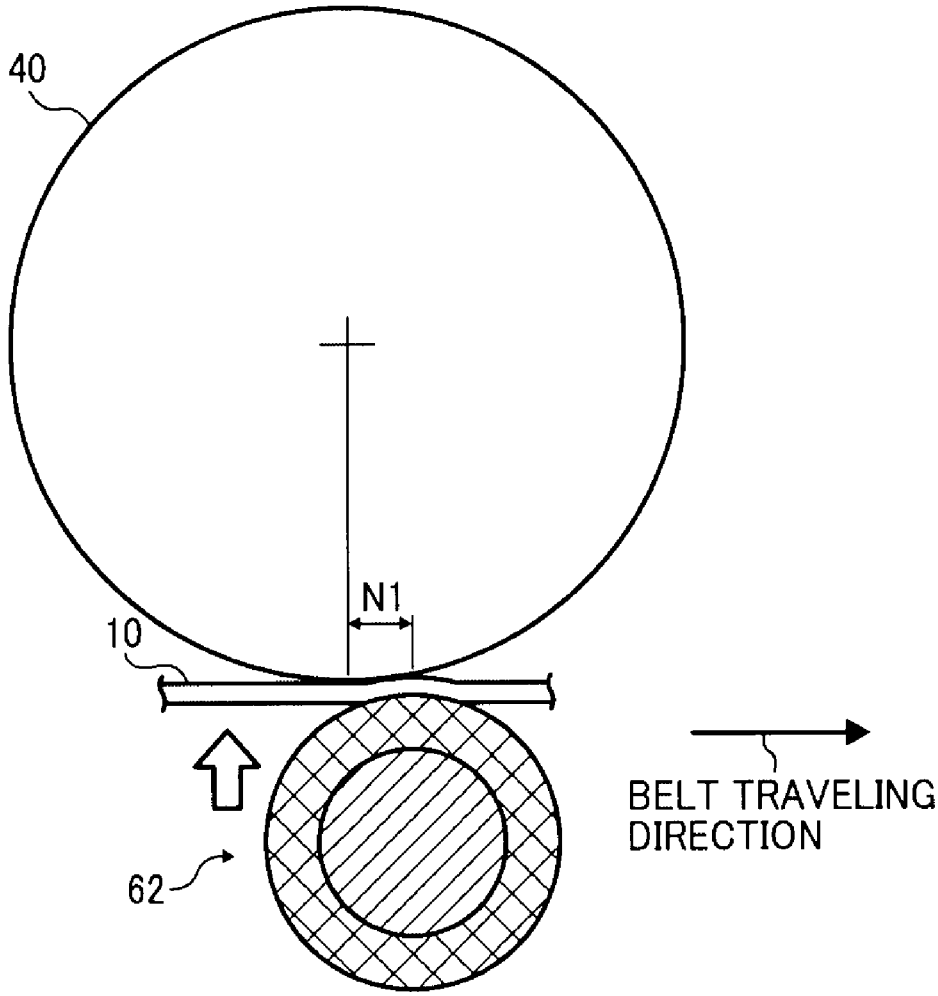
FIG. 8 is an enlarged view for explaining relationship between pressing force and nip width.

As illustrated in FIG. 8, when the pressing force of the primary transfer member 62 varies, a nip width "N1" also varies. The nip width "N1" is a length of the transfer area, formed between the photoconductor 40 and the intermediate transfer belt 10, in a traveling direction of the intermediate transfer belt 10.

When the intermediate transfer belt 10 has a relatively large contact area with the photoconductor 40, a variation of the nip width "N1" is relatively low compared to when the intermediate transfer belt 10 has a relatively small contact area with the photoconductor 40. As a result, the variation in the transfer electric field or friction resistance applied to the photoconductor 40, which is caused by such variation in the pressing force, is relatively small. Further, when the primary transfer unit is a hard-metal roller member, such variation in the pressing force may have little effect on the nip width "N1", thereby enhancing the stability of the nip width "N1".

Exemplary embodiments of the present disclosure are not limited to the above-described exemplary embodiments and may be any suitable type of image forming apparatus having a transfer units capable of changing a transfer condition based on a difference in surface friction coefficient between photoconductors. Accordingly, if different types of transfer members, for example, a transfer belt and a sheet, have an identical friction coefficient, similar results can be obtained with such different types of transfer members. Accordingly, such exemplary embodiments are applicable to, for example, known direct-transfer-type image forming apparatus having a plurality of photoconductors arranged in a tandem manner.

Examples and embodiments being thus described, it should be apparent to one skilled in the art after reading this disclosure that the examples and embodiments may be varied in many ways. Such variations are not to be regarded as a departure from the spirit and scope of the present invention, and such modifications are not excluded from the scope of the following claims.

What is claimed is:

1. An image forming apparatus, comprising:

a plurality of image forming units comprising corresponding image carriers and charging units, the image forming units configured to form toner images of different colors on the corresponding image carriers;

a plurality of transfer units disposed to face the corresponding image carriers to form transfer areas between the transfer units and the image carriers and configured to press a transfer member, passing through the transfer areas, to the corresponding image carriers to transfer the toner images, formed on the corresponding image carriers, onto the transfer member at the transfer areas;

wherein the charging units include at least one charging member of corona charging type and at least one charging member of contact charging type, and wherein the image forming apparatus sets a first transfer condition for the transfer unit(s) corresponding to the image carrier(s) charged by the at least one charging member of corona charging type and a second, separate transfer condition for the transfer unit(s) corresponding to the image carrier(s) charged by the at least one charging member of contact charging type.

2. The image forming apparatus according to claim 1, wherein the transfer member is an intermediate transfer member and the transfer units are primary transfer units configured to transfer toner images, formed on the corresponding image carriers, onto the intermediate transfer member.

3. The image forming apparatus according to claim 2, further comprising a secondary transfer unit configured to collectively transfer the toner images, transferred on the intermediate transfer member, onto a recording medium.

4. The image forming apparatus according to claim 1, wherein each of the first and second transfer conditions is pressing forces with which the transfer units press a transfer member, passing through the transfer areas, to the corresponding image carriers.

5. The image forming apparatus according to claim 4, wherein the pressing force of the first transfer condition is smaller than the pressing force of the second transfer condition.

6. The image forming apparatus according to claim 1, wherein each of the first and second transfer conditions is a difference in linear velocity at the corresponding transfer area between the corresponding image carrier and the transfer member.

7. The image forming apparatus according to claim 6, wherein the difference in linear velocity of the first transfer condition is greater than the difference in linear velocity of the second transfer condition.

8. The image forming apparatus according to claim 1, wherein one image forming unit of the image forming units forms a black toner image as one of the toner images of different colors and comprises an electrifying charger as the charging member of corona charging type.

9. The image forming apparatus according to claim 1, wherein at least one image forming unit of the image forming units forms a toner image of a color other than black as one of the toner images of different colors and comprises a charging roller as the charging member of contact charging type.

10. The image forming apparatus according to claim 1, wherein the toner images of different colors includes toner images of black and other colors, and wherein the image forming units are arranged in an order so that, among the toner images of all colors, the black toner image is transferred last of all onto the transfer member.

11. An image forming apparatus, comprising:

a plurality of image forming units comprising corresponding image carriers and charging units, the image forming units configured to form toner images of different colors on the corresponding image carriers;

a plurality of transfer units disposed to face the corresponding image carriers to form transfer areas between the transfer units and the image carriers and configured to press a transfer member, passing through the transfer areas, to the corresponding image carriers to transfer the toner images, formed on the corresponding image carriers, onto the transfer member at the transfer areas;

wherein the charging units include at least one charging member of corona charging type and at least one charging member of proximate charging type, and wherein the image forming apparatus sets a first transfer condition for the transfer unit(s) corresponding to the image carrier(s) charged by the at least one charging member of corona charging type and a second, separate transfer condition for the transfer unit(s) corresponding to the image carrier(s) charged by the at least one charging member of proximate charging type.

12. The image forming apparatus according to claim 11, wherein the transfer member is an intermediate transfer member and the transfer units are primary transfer units configured to transfer toner images, formed on the corresponding image carriers, onto the intermediate transfer member.

13. The image forming apparatus according to claim 12, further comprising a secondary transfer unit configured to collectively transfer the toner images, transferred on the intermediate transfer member, onto a recording medium.

14. The image forming apparatus according to claim 11, wherein each of the first and second transfer conditions is pressing forces with which the transfer units press a transfer member, passing through the transfer areas, to the corresponding image carriers.

15. The image forming apparatus according to claim 14, wherein the pressing force of the first transfer condition is smaller than the pressing force of the second transfer condition.

16. The image forming apparatus according to claim 11, wherein each of the first and second transfer conditions is a difference in linear velocity at the corresponding transfer area between the corresponding image carrier and the transfer member.

17. The image forming apparatus according to claim 16, wherein the difference in linear velocity of the first transfer condition is greater than the difference in linear velocity of the second transfer condition.

18. The image forming apparatus according to claim 11, wherein one image forming unit of the image forming units forms a black toner image as one of the toner images of different colors and comprises an electrifying charger as the charging member of corona charging type.

19. The image forming apparatus according to claim 11, wherein at least one image forming unit of the image forming units forms a toner image of a color other than black as one of the toner images of different colors and comprises a charging roller as the charging member of proximate charging type.

20. The image forming apparatus according to claim 11, wherein the toner images of different colors includes toner images of black and other colors, and wherein the image forming units are arranged in an order so that, among the toner images of all colors, the black toner image is transferred last of all onto the transfer member.

* * * * *